United States Patent [19]

Lapp

[11] Patent Number: 4,809,918

[45] Date of Patent: Mar. 7, 1989

[54] APPARATUS FOR WINDING WIRE ONTO AN ARBOR

[75] Inventor: Roger H. Lapp, Silver Spring, Md.

[73] Assignee: The Johns Hopkins University, Baltimore, Md.

[21] Appl. No.: 115,291

[22] Filed: Nov. 2, 1987

[51] Int. Cl.[4] ..... B65H 81/06

[52] U.S. Cl. ..... 242/7.21; 57/3; 57/10; 57/11; 242/7.22

[58] Field of Search ..... 57/3, 10, 11, 13; 242/7.06, 7.08, 7.09, 7.11, 7.14–7.16, 7.19–7.23

[56] References Cited

U.S. PATENT DOCUMENTS

| | | | |
|---|---|---|---|
| 1,890,739 | 12/1932 | Lunt | 57/10 |
| 2,674,084 | 4/1954 | Ratte et al. | 57/10 |
| 3,026,052 | 3/1962 | Wade | 57/10 X |
| 3,029,586 | 4/1962 | Walsh et al. | 57/3 |
| 3,162,992 | 12/1964 | Davis et al. | 57/10 |
| 3,259,370 | 7/1966 | Neale, Sr. | 57/10 X |
| 3,479,808 | 11/1969 | Frill | 57/13 X |
| 3,851,831 | 12/1974 | Steiner et al. | 242/7.22 |
| 3,882,662 | 5/1975 | Hazelwood | 57/10 |
| 4,142,352 | 3/1979 | Greczin | 57/10 X |
| 4,196,863 | 4/1980 | Sakaue | 242/7.23 X |
| 4,346,550 | 8/1982 | Ferree | 242/7.08 X |
| 4,358,064 | 11/1982 | Garneau | 242/7.23 |

*Primary Examiner*—John Petrakes

*Attorney, Agent, or Firm*—Robert E. Archibald; Francis A. Cooch

[57] ABSTRACT

Wire winding apparatus for winding wire about an arbor having a straight or curved center line and having either a circular or a nearly circular cross-section. The wire winding apparatus includes a frame having two parallel spaced apart triangular shaped ends, a spool holder disposed between the frame ends for holding at least one spool of wire, a wire straightening device disposed between the frame ends for straightening the wire as it comes off the spool, wire laying apparatus disposed between the frame ends having three wheels with flanges for helically laying the wire onto the arbor whereby each turn of the wire is wound nearly perpendicular to the center line of the arbor and an arbor engagement device attached to the frame for engaging the arbor and causing the wire winding apparatus to remain in intimate rotational contact with the arbor. The wire winding apparatus also includes a center of gravity adjustment device for adjustably controlling the location of the center of gravity of the wire winding apparatus and a rotary slip clutch mechanism for adjustably applying friction to the spool holder causing an adjustable tension in the wire. The rotary slip clutch mechanism includes a retract spring for causing the spool holder to rotate counter to the direction of payoff one-half of one full revolution retracting wire previously laid onto the arbor thereby minimizing entanglements caused by loose turns of wire.

12 Claims, 2 Drawing Sheets

APPARATUS FOR WINDING WIRE ONTO AN ARBOR

STATEMENT OF GOVERNMENT INTEREST

The Government has rights in this invention pursuant to contract No. N00039-87-C-5301 awarded by the Department of the Navy.

BACKGROUND OF THE INVENTION

The present invention relates to apparatus for winding wire onto an arbor, and more particularly to apparatus for helically winding wire onto an arbor having a straight or curved center line and a circular or a nearly circular cross-section whereby each helical turn of the wire is nearly perpendicular to the center line of the arbor.

There is a need for apparatus which can wind wire into tight helical turns about an arbor having a curved or straight center line and a circular or a nearly circular cross-section. Normally, such wire winding apparatus is designed to wind wire about an arbor having a straight center line and a circular cross-section. Applications for apparatus of the above-described type are widespread and include such diverse fields as wire reinforcement of high pressure pipes, fabrication of overmoded waveguides, and cable lashing. Some features which are highly desired in such apparatus are: the ability to wind tight uniform helical turns about an arbor having either a straight or a curved center line and either a circular or a nearly circular cross-section; maintaining constant adjustable tension in the wire; and controlling the center of gravity of the wire winding apparatus as its weight gets redistributed due to the payoff of wire from the spool.

Various devices have been proposed for winding wire about an arbor. However, the proposed devices suffer from various disadvantages. For example, U.S. Pat. No. 1,890,739 discloses an apparatus for wrapping elongated material or the like about a cable having a frame or spool holder which has two parallel, spaced apart side members which are attached to the outside of a semi-circular shell or the like. A spool of wire is held between the side members and wire from the spool is guided through a hole in the shell. The hole in the shell coincides with a plurality of successive grooves in the shell which guide the wire into a helical or spiral configuration about the cable. The device is manually rotated about the cable thereby winding the elongated material about the cable.

U.S. Pat. No. 4,358,064 discloses a machine for wrapping a pipe with tape or another strip of material. The machine includes a frame defined by a pair of spaced apart V-shaped ends and two pairs of wheels which straddle the pipe. The first pair of wheels are connected to one end of the frame and the second pair of wheels are connected to the other end of the frame. The tape is wound onto the pipe when the frame is rotated about the pipe. One end of the frame is rotatable relative to the other end so that the pair of wheels on one end can move out of alignment with the pairs on the other end in order to change the path of travel of the frame on the pipe from a circular to a helical path.

As previously stated, the wire winding apparatus disclosed by the patents identified above suffers from various disadvantages; namely, they are not designed to wind wire about a curved as well as a straight arbor having either a circular or nearly circular cross-section, they do not maintain a constant adjustable tension on the wire, and they do not provide a device for controlling the location of the center of gravity of the apparatus.

The present invention solves the above described disadvantages by providing a wire winding apparatus which has the ability to wind wire about a curved as well as a straight arbor having either a circular or nearly circular cross-section, maintain a constant adjustable tension in the wire being wound and control the location of the center of gravity of the wire winding apparatus during the winding operation. Still further, the wire winding apparatus has the ability to retract onto the spool of wire one-half of one revolution of wire previously laid onto the arbor without losing tension in the wire.

SUMMARY OF THE INVENTION

According to the present invention, an apparatus for winding wire about a curved as well as a straight arbor is provided. The wire winder of the present invention provides a self-contained apparatus that engages an arbor having preferably a circular or nearly circular cross section. The wire winding apparatus is manually operated to wind wire into tight helical turns about the arbor wherein each helical turn of the wire is wound nearly perpendicular to the center line of the arbor.

The present invention includes a frame having two parallel spaced apart triangular shaped ends, a back plate and a bottom plate; a spool holder disposed between the frame ends for holding a spool of wire; a wire straightening device disposed between the frame ends for straightening the wire as it comes off a spool of wire placed on the spool holder; wire laying apparatus disposed between the frame ends having three wheels with flanges for helically laying wire from the spool onto the arbor such that the turns of wire are nearly perpendicular to the center line of the arbor and an arbor engagement device attached to the frame for engaging the arbor and causing the wire winding apparatus to remain in intimate rotational contact with the arbor.

The present invention also includes a center of gravity adjustment device for adjustably controlling the location of the center of gravity of the apparatus and a rotary slip clutch mechanism which adjustably applies friction to the spool holder causing an adjustable constant tension in the wire. The rotary slip clutch mechanism also includes a retract spring which operates when the apparatus comes to rest causing the spool holder to rotate one-half of one full revolution counter to the direction of payoff thereby retracting wire previously laid onto the arbor. The retract spring minimizes entanglements caused by loose turns of wire which appear when the winding apparatus backs up slightly as it comes to rest.

BRIEF DESCRIPTION OF THE DRAWINGS

The above-described features and advantages of the present invention will become apparent upon reading the following specification and by reference to the drawings wherein.

DETAILED DESCRIPTION OF THE INVENTION

The present invention provides wire winding apparatus for winding wire into helical turns having a controlled tension about a curved or a straight arbor having either a circular or a nearly circular cross-section. The apparatus of the present invention can be used in fabricating overmoded waveguides, lashing cables, or reinforcing high pressure pipes. The apparatus of the present invention is designed to be manually operated to perform the wire winding process.

Figure 1:
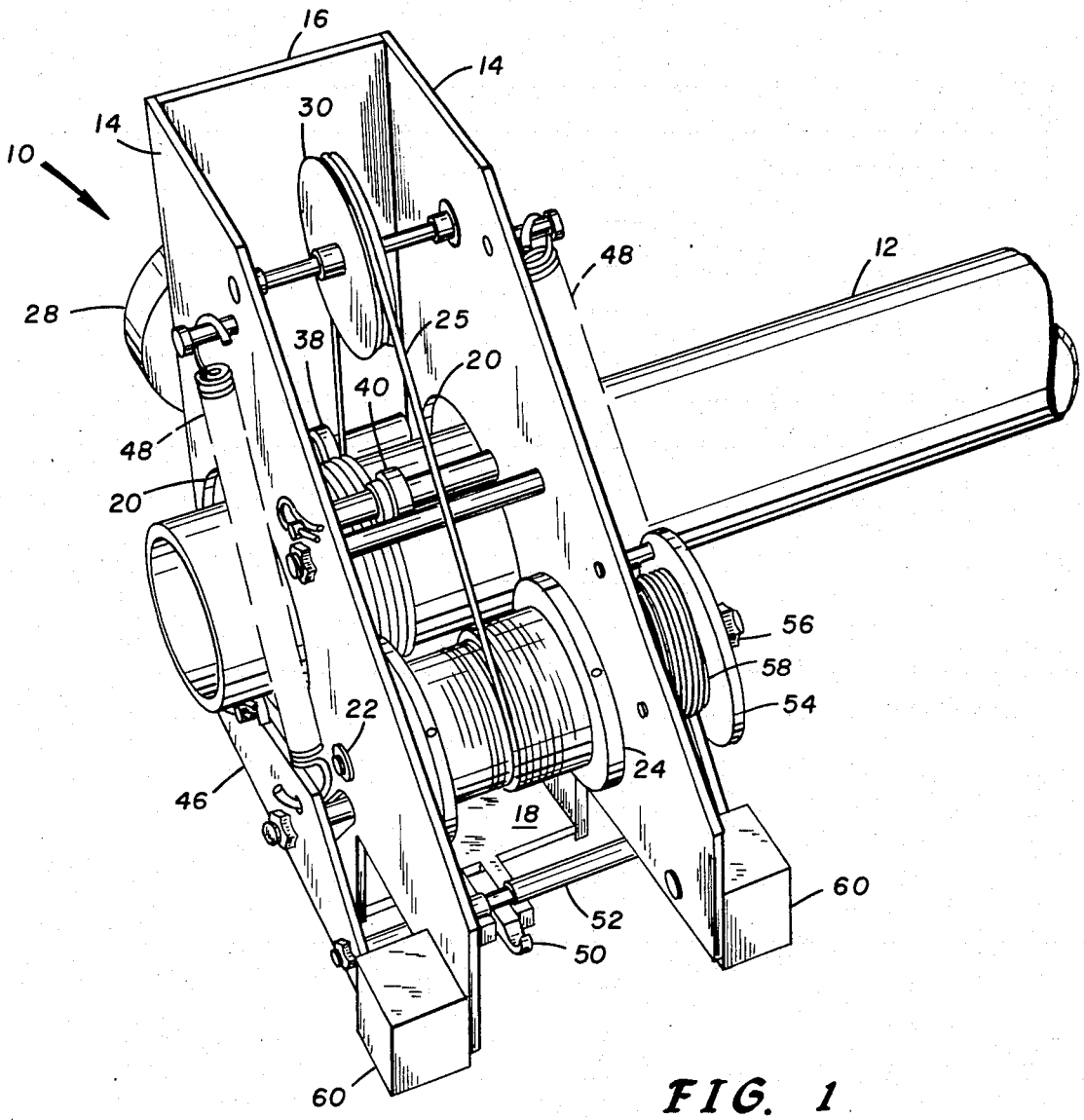
FIG. 1 is a perspective view of the wire winding apparatus of the present invention.

FIG. 1 illustrates the wire winding apparatus generally shown as 10 engaging an arbor 12, and adapted for rotation relative thereto. The arbor 12 is shown as having a circular cross section and a straight center line. However, the apparatus can wind wire about an arbor having a curved center line or a nearly circular cross-section. The wire winding apparatus shown in FIGS. 1, 3 and 5 includes a frame having two parallel spaced apart ends 14 each having a triangular shape. The frame also includes a back plate 16 integral with the two ends 14 and a bottom plate 18 integral with the two ends 14 and the back plate 16. A volumetric area 20 is defined in the frame to accommodate the arbor 12. The volumetric area 20 is positioned in the ends 14 of the frame such that the arbor 12 if straight extends perpendicularly through both ends 14 of the frame. If the arbor is curved the volumetric area 20 accommodates the arbor such that the wire winding apparatus is perpendicular to the arbor at the plane where wire to be wrapped around the arbor first contacts the arbor.

A spool holder 22 positioned between the two ends 14 of the frame, rotationally holds at least one spool of wire 24 having wire 25 wound thereon. A plurality of spools of wire can be provided with each spool carrying wire which is simultaneously wound onto the arbor with wire from the other spools thereby increasing the speed and efficiency of the wire winding apparatus. In addition, a plurality of spools may be disposed in the wire winding apparatus such that the weight distribution of the wire winding apparatus does not change during the winding process.

A center of gravity adjustment device is provided for maintaining a constant center of gravity in the wire winding apparatus. The center of gravity adjustment device is an important feature, for as wire 25 is removed from the spool 24 and wound onto the arbor 12, weight from the spool 24 is transferred from the spool to the arbor which of course is not a part of the wire winding apparatus. Therefore, the apparatus would have a tendency to not be balanced on the arbor and fall to the underside of the arbor when the apparatus comes to rest. Such actions on the part of the apparatus reduce the tension in the wire and cause entanglements.

Figure 3:
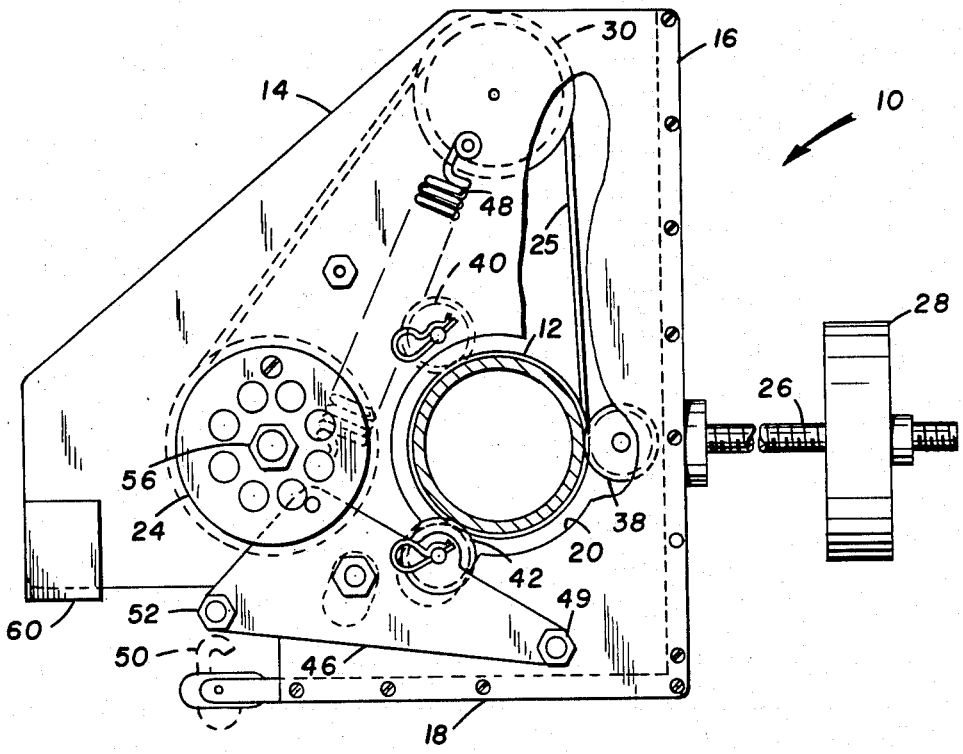
FIG. 3 is a end view of the wire winding apparatus of the present invention.

A first embodiment of the center of gravity adjustment device shown in FIG. 3 includes a shaft 26 having a screw thread thereon. One end of the shaft 26 is attached to the back plate 16 of the frame whereby the center line of the shaft 26 intersects the center line of the arbor 12 and the spool of wire 24. The first embodiment of the center of gravity adjustment device also includes a weight 28 having a screw thread therein. The weight 28 is adjustably positioned on the shaft 26 by meshing the shaft screw thread and the weight screw thread. The weight 28 and the shaft 26 combination being attached to the back plate 16 of the frame permits the operator of the apparatus to control the location of the center of gravity of the apparatus by positioning the weight 28 at various points along the length of the shaft 26 as the winding process progresses.

A second embodiment of the center of gravity adjustment device may be provided as described above by use of two or more spools of wire disposed diametrically opposite each other within the frame. Since wire from each spool is removed simultaneously the weight of each spool decreases at approximately the same rate. Therefore, the distribution of weight within the apparatus remains constant thereby maintaining a constant center of gravity.

Figure 2:
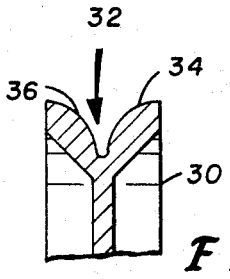
FIG. 2 is a partial view of the wire straightening apparatus of the present invention.

A wire straightening device 30 as shown in FIGS. 1, 2, 3 and 5 positioned between the two ends 14 of the frame straightens the wire 25 as it comes off the spool 24 and guides the wire 25 to the arbor 12. The wire straightening device 30 is made in the shape of a disc having a groove 32 on its circumferential surface. The groove 32 as shown in FIG. 2 includes an upper portion 34 having sides that are angled inward and a lower portion 36 having parallel sides. The cross-section of the groove 32 resembles that of a funnel. The wire straightening device is disposed on a shaft between the two ends 14 of the frame at a position above the arbor 12. Wire 25 from the spool 24 is fed to the groove 32 of the wire straightening device 30 and guided thereby to wire laying apparatus which shall be described in more detail below. The wire is straightened by forces exerted on the wire by the parallel sides 36 of the groove 32.

Figure 4:
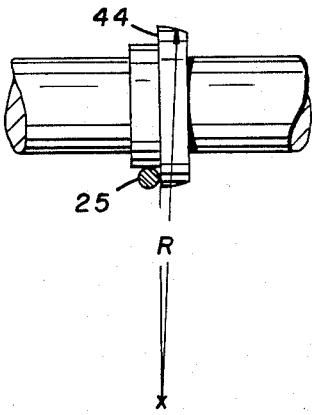
FIG. 4 is a front view of a wheel of the wire laying apparatus of the present invention.

Wire laying apparatus is provided for helically laying the wire onto the arbor whereby each helical turn of the wire is wound nearly perpendicular to the center line of the arbor 12. The wire laying apparatus is disposed between the ends 14 of the frame near the volumetric area 20 provided in the frame to accommodate the arbor 12. The wire laying apparatus lays the current turn of wire adjacent the previously laid turn of wire to form a helical wrapping about the arbor 12. The wire laying apparatus includes a stationary wheel 38, a wire laying wheel 40, and a movable wheel 42. All three wheels have the same structure shown in FIG. 4. In FIG. 4 each wheel is shown as having a flange 44 on one side. The wheels are nearly equally spaced around the periphery of the volumetric area 20.

The curvature of the circumferential surface of flange 44 as depicted by the symbol "R" in FIG. 4 is approximately the same curvature as the curved centerline of a curved arbor 12. The curvature in the circumferential surface of the flange 44 enhances the perpendicularness of the helical turns wound about an arbor having a curved center line thereby producing a better product.

Figure 5:
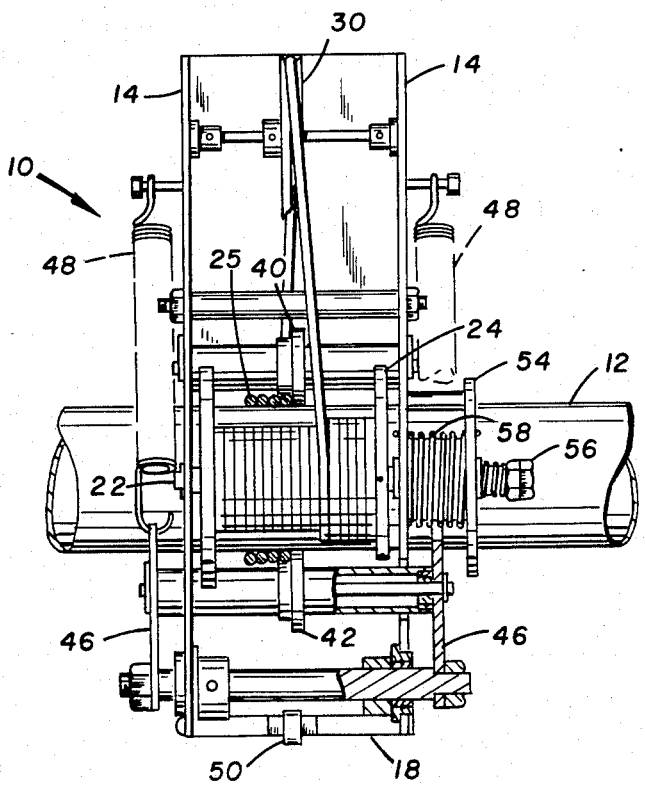
FIG. 5 is a partial side view of the wire winding apparatus of the present invention.

The height of the flange 44 on each wheel 38, 40 and 42 as shown in FIG. 4 is the same as the diameter of the wire 25. Thus two circumferential surfaces are created by the wheel, a larger one created by the flange 44 and a smaller one created by the other part of the wheel. As shown in FIGS. 1, 3 and 5, as the wire 25 is laid onto the arbor 12, the larger circumferential surface of the wheel rides on the arbor 12 and the smaller circumferential surface of the wheel rides on the wire turns previously wrapped onto the arbor 12. The wire laying wheel 40 lays wire onto the arbor as it comes off the wire straightening device 30.

An arbor engagement device 46 as shown in FIG. 3 is resiliently mounted onto the frame by a spring 48 and a pivoting point provided by a bolt 49. The resilient force of the spring 48 is equal to or greater than the weight of the apparatus. Due to the resilient mounting of the arbor engagement device 46 out-of-round or non or nearly circular arbors can be accommodated by the apparatus.

The movable wheel 42 of the wire laying apparatus as shown in FIGS. 3 and 5 is attached to a shaft which is attached to the arbor engagement device 46. A latch 50 pivotally attached to the bottom plate 18 and a latch pin 52 attached to the arbor engagement device 46 provides a mechanism for holding open the arbor engagement device 46 against the force of spring 48. When the arbor engagement device 46 is pivoted about bolt 49, and held open by latch 50 being removably attached to latch pin 52, the movable wheel 42 is moved away from the periphery of the volumetric area 20 thereby permitting an arbor to be easily inserted into the volumetric area 20.

Once an arbor as shown in FIGS. 3 and 5 is in position in the volumetric area 20 and the latch 50 is unlatched from latch pin 52, the arbor engagement device 46 retracts to its original position, thus moving the movable wheel 42 into contact with the arbor 12. The movable wheel 42 transmits forces from the arbor engagement device 46 to the arbor 12, thereby pressing the arbor 12 against the stationary wheel 38 and the wire laying wheel 40. Thus, the wire winding apparatus is caused by the arbor engagement device 26 to remain in intimate rotational contact with the arbor 12.

Constant tension is maintained in the wire by a rotary slip clutch mechanism 54 as shown in FIGS. 1 and 5. The rotary slip clutch mechanism 54 operates by providing frictional forces to the spool holder to slow the rotation of the spool of wire 24 and the spool holder 22. The friction applied to the spool holder 22 can be adjusted by adjustment nut 56. In addition, a retract spring 58 is built into the rotary slip clutch mechanism 54 for causing the spool holder 22 to rotate one-half of a full revolution counter to the direction at which the wire 25 is removed thereby retracting previously laid wire back onto the spool 24. The retract spring 58 also maintains tension on the wire 25 if the apparatus is inadvertently rotated backward on the arbor 12.

Counter balances 60 as shown in FIGS. 1 and 3 are provided as an aid to balance the wire winding apparatus in a plane orthogonal to the plane of weight 18.

The present invention operates as follows:

An arbor having a circular or a nearly circular cross section and either a straight or curved center line is inserted into the volumetric area of the frame of the wire winding apparatus by pivoting the resiliently mounted arbor engagement device and latching it open to a pivoted position away from the volumetric area of the frame; then inserting the arbor into the volumetric area. The arbor engagement device is then unlatched allowing the arbor engagement device, including the movable wheel attached thereto, to retract and press onto the arbor. The movable wheel being attached to the arbor engagement device is pressed against the arbor causing the arbor to rest against the stationary wheel and the wire laying wheel.

A spool having been previously wound with wire is placed on the spool holder. Wire from the spool is threaded through the wire straightening device and the wire laying apparatus and secured onto the surface of the arbor by an independent device. As the first turns of wire are laid the wire winding apparatus erects itself to lay wire nearly perpendicular to the local center line of the arbor. The center of gravity of the wire winding apparatus is adjusted by moving the weight on the shaft until the apparatus balances itself on the arbor. The weight is designed to be adjusted as needed during the winding operation. This is highly desirable in that as wire is spent from the spool of wire the weight distribution of the apparatus changes thus changing the center of gravity of the apparatus.

The wire winding apparatus is manually rotated about the arbor in order to helically wind wire onto the arbor. The wire is laid onto the arbor by the wire laying apparatus such that each helical turn of the wire is wound nearly perpendicular to the center line of the arbor. The wire laying apparatus includes a stationary wheel, a wire laying wheel and a movable wheel each spaced apart from each other. The movable wheel and its shaft as indicated above is attached to the arbor engagement device. Each wheel has a flange which is the height of the wire. Wire from the spool is threaded between the wheel and the arbor such that the large circumference of each wheel rides on the arbor and the smaller circumference of each wheel rides on the current and previous wire turns wrapped onto the arbor. The wheels not only cause the wire winding apparatus to follow the surface of the arbor, they act to lay turns of wire nearly perpendicular to the arbor center line. In addition, the wheels compact and make tight the helical turns on a straight arbor and compact turns where required on a curved arbor.

Constant tension is provided to the wire by a rotary slip clutch mechanism which operates by applying frictional forces to the spool holder thereby creating tension in the wire as it is laid. In addition, when the wire winding apparatus comes to rest, a retract spring, within the rotary slip clutch mechanism, causes the spool to maintain wire tension. The retract spring prevents loss of tension in the wound wire in the event of inadvertent reverse rotation of the winding apparatus. The retract spring is designed to put wire back onto the spool without loss of tension up to a limited amount of reverse rotation.

Having described a preferred embodiment of a novel wire winding apparatus in accordance with the present invention, it is believed that other modifications, variations and changes will be suggested to those skilled in the art in view of the teachings set forth herein. It is, therefore, to be understood that all such variations, modifications and changes are believed to fall within the scope of the present invention as defined by the appended claims.

What is claimed is:

1. Wire winding apparatus for winding wire into helical turns about an arbor having a straight or curved center line said apparatus comprising:

spool holder means for holding at least one spool of wire;

wire straightening means for straightening the wire as it comes off the spool;

wire laying means for helically laying the wire onto the arbor whereby each helical turn of the wire is wound nearly perpendicular to the center line of the arbor;

arbor engagement means for rotationally engaging the arbor and causing said apparatus to remain in intimate rotational contact with the arbor;

center of gravity adjustment means for maintaining a center of gravity of said apparatus as wire is wound by said apparatus about said arbor; and rotary slip clutch means for providing frictional forces to said spool holder means to slow the rotation of said spool holder means thereby maintaining constant tension in the wire being wound.

2. Apparatus according to claim 1 wherein said rotary slip clutch means comprises:

retract spring means for causing the spool holder means to rotate at least one half of one full revolution counter to the direction at which the wire is removed from the spool thereby retracting previously laid wire back onto the spool.

3. Apparatus according to claim 1 wherein said wire straightening means comprises:

a disk having a groove in its circumferential surface wherein said groove has a cross-sectional shape in the form of a funnel whereby wire from said spool of wire is threaded within the groove and is straightened by forces exerted on the wire by the two opposing sides of the groove.

4. Apparatus according to claim 3 wherein said wire laying means comprises:

a stationary wheel, a wire laying wheel and a movable wheel, each wheel being mounted on separate shafts within said apparatus, wherein each wheel is nearly equally spaced from each other around the periphery of a volumetric area wherein wire from said wire straightening means is laid onto said arbor by said wire laying wheel.

5. Apparatus according to claim 4 wherein each wheel of said wire laying means comprises:

a flange on one side of the wheel, wherein the height of said flange is at least the diameter of the wire whereby the circumferential surface of the wheel rides on the current and previously wound turns of wire and the circumferential surface of the flange rides on the surface of the arbor.

6. Apparatus according to claim 5 wherein the circumferential surface of said flange has a curvature the same as the curvature of an arbor having a curved center line.

7. Apparatus according to claim 6 wherein said spool holder means, said wire straightening means and said wire laying means are disposed within a frame, said frame having first and second ends which are spaced apart and parallel to each other, a back plate integral with said first and second ends of said frame, and a bottom plate integral with said first and second ends and said back plate of said frame wherein a volumetric area is defined within said first and second ends of said frame to accommodate an arbor such that the arbor extends through said first and second ends of said frame.

8. Apparatus according to claim 7 wherein said arbor engagement means is mounted on the frame adjacent the volumetric area.

9. Apparatus according to claim 8 wherein one end of said arbor engagement means is pivotally mounted to the frame and the other end of said arbor engagement means is resiliently mounted to the frame whereby said apparatus may be placed in intimate rotational contact with an arbor by pivoting the arbor engagement means to a pivoted position away from the volumetric area, inserting an arbor into the volumetric area and permitting the resiliently mounted arbor engagement means to retract onto the arbor.

10. Apparatus according to claim 9 wherein the shaft of said movable wheel is attached to the arbor engagement means, said movable wheel being used by said arbor engagement means to transmit forces from said arbor engagement means to the arbor thereby pressing the arbor into contact with said stationary wheel and said wire laying wheel.

11. Apparatus according to claim 10 further comprising a latch attached to said bottom plate; and a latch pin attached to said arbor engagement means wherein said latch and latch pin combination is provided to permit an operator to temporarily hold said arbor engagement means in the pivoted position while inserting an arbor in the volumetric area by removably attaching said latch to said latch pin.

12. Apparatus according to claim 11 wherein said center of gravity adjust means further comprises:

a shaft having a screw thread thereon, said shaft having one end thereof attached to the back of said apparatus; and a weight having a screw thread therein whereby said weight is adjustably positioned on said shaft by said screw thread therein permitting an operator to adjust the center of gravity of said apparatus by adjusting the position of said weight on said shaft.

* * * * *